United States Patent [19]

Howse, Jr. et al.

[11] 4,202,854

[45] May 13, 1980

[54] POLYAMIDE SPIN-TEXTURE PROCESS

[75] Inventors: Paul T. Howse, Jr., Pensacola; Arnold E. Wilkie, Pensacola Beach, both of Fla.

[73] Assignee: Monsanto Company, St. Louis, Mo.

[21] Appl. No.: 864,127

[22] Filed: Dec. 23, 1977

[51] Int. Cl.[2] ..... D01D 5/22

[52] U.S. Cl. ..... 264/168; 264/210.7; 264/290.7

[58] Field of Search ..... 264/210 F, 168

[56] References Cited

U.S. PATENT DOCUMENTS

| | | | |
|---|---|---|---|
| 3,555,139 | 1/1971 | Water et al. | 264/210 F |
| 3,732,346 | 5/1973 | Mallonee et al. | 264/210 F |
| 3,822,334 | 7/1974 | Patterson | 264/210 F |
| 3,936,253 | 2/1976 | Fisher et al. | 264/210 F |
| 4,042,662 | 8/1977 | Corbin et al. | 264/210 F |
| 4,069,657 | 1/1978 | Bascom et al. | 264/210 F |
| 4,096,226 | 6/1978 | Martin et al. | 264/210 F |

FOREIGN PATENT DOCUMENTS

| | | | |
|---|---|---|---|
| 45-24685 | 8/1970 | Japan | 264/210 F |
| 46-13933 | 4/1971 | Japan | 264/210 F |
| 48-28012 | 8/1973 | Japan | 264/210 F |
| 1174867 | 12/1969 | United Kingdom | 264/210 F |

*Primary Examiner*—Jay H. Woo

*Attorney, Agent, or Firm*—John W. Whisler

[57] ABSTRACT

A spin-texture process for producing polyamide yarns is described in which a freshly extruded yarn is passed between two pairs of rotating rolls and then collected. The second pair of rolls (draw rolls) is driven at a peripheral speed greater than that of the first pair of rolls (feed roll and its associated separator roll). The feed roll is maintained and a given temperature which is correlated with other processing conditions to impart a desired level of latent crimp to the yarn. Yarns prepared by the process have a potential bulk of between 10% and 50% and are particularly useful as carpet yarns.

15 Claims, 1 Drawing Figure

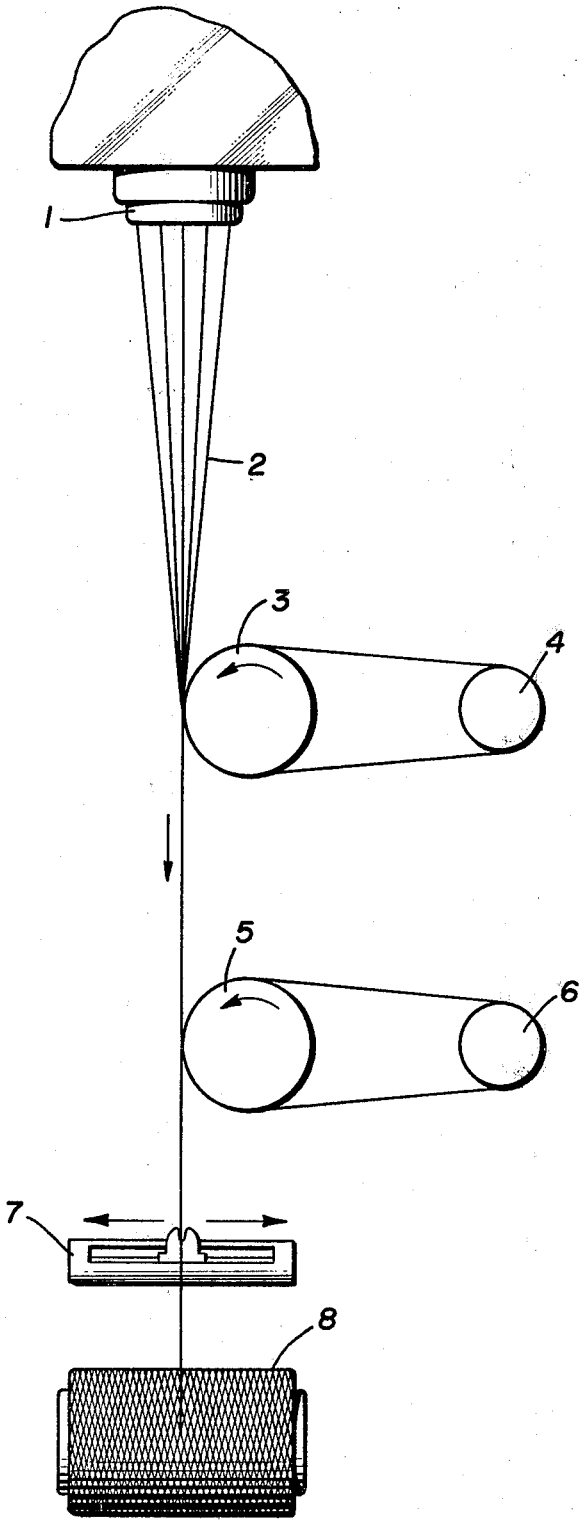
1
2
3
4
5
6
7
8

POLYAMIDE SPIN-TEXTURE PROCESS

BACKGROUND OF THE INVENTION

A. Field of the Invention

This invention relates to a novel melt spinning process for producing drawn (i.e. molecularly oriented) polyamide yarn having latent crimp in which the latent crimp is imparted to individual filaments of the yarn without the application of any special crimping apparatus or steps. The term "yarn" is used herein to mean a single filament (mono-filament yarn) or a bundle of filaments (multifilament yarn).

B. Description of the Prior Art

Various mechanical techniques are known for imparting crimp to polyamide yarns. Normally, these techniques require the spun yarn to be fully drawn prior to the crimping step. In general, these techniques involve heating a fully drawn polyamide yarn, deforming the hot yarn, then cooling the yarn while it is in the deformed state, and finally removing the deformations from the cooled yarn. One such technique, gear crimping, involves passing drawn polyamide yarn between two gears, the teeth of which intermesh. The speed at which the yarn can travel between the gears is limited and is considerably slower than the capabilities of present day melt spinning equipment. Consequently, gear crimping is normally accomplished by an operation separate from that of spinning and, therefore, has cost disadvantages from the standpoint of commercial operations. On the other hand, even those crimping techniques which may be accomplished at high speeds and thus coupled with the spinning and drawing operations, such as stufferbox crimping or jet texturing, utilize special equipment and require a separate and expensive texturing step following the spinning and drawing steps.

Another technique which has been utilized for imparting crimp to polyamide yarn is that of spinning a conjugate filament in which two dissimilar polyamides of dissimilar properties (e.g. shrinkage) are united nonconcentrically with respect to the filament axis. This technique, however, requires expensive and elaborate equipment for melting and extruding the two polyamides.

An object of the present invention is to provide a simple and effective process for producing a polyamide yarn having latent crimp which avoids the drawbacks of the abovementioned crimping techniques.

Other objects and advantages of the invention will become apparent from the following detailed description thereof.

SUMMARY OF THE INVENTION

In general, this invention provides a commercially attractive melt spinning process for continuously producing a polyamide yarn and preferably a multifilament polyamide yarn having latent crimp in which the latent crimp is imparted to individual filaments without the use of any special crimping equipment or steps. This process is carried out under conditions (hereinafter described) such that upon development of the latent crimp the yarn has a bulk (hereinafter defined) of at least 10% and, preferably, at least 15% with a bulk in the range of 15% to 40% being particularly preferred. Multifilament polyamide yarn having a bulk of between 15% and 40% may be suitably used in the construction of carpets without further texturing of the yarn, thereby eliminating costly texturing operations.

More specifically, the invention provides a process for continuously producing a polyamide yarn having latent crimp, comprising:

(a) extruding molten fiber-forming polyamide at a given extrusion rate through a spinneret having a given number of orifices to form a given number of molten streams;

(b) cooling said given number of molten streams in a quenching zone to form a given number of filaments;

(c) withdrawing said given number of filaments from said quenching zone;

(d) heating at least one said filament in a heating zone;

(e) drawing said given number of filaments at a draw ratio greater than 1.0 before said at least one filament reaches equilibrium crystallization; and (f) collecting said yarn;

wherein said extrusion rate, said heating and said drawing are correlated to provide a yarn of a given denier per filament having latent crimp and a bulk after development of said latent crimp of at least 10% and preferably at least 15%. The process of this invetnion is particularly useful in producing multifilament yarn in which latent crimp is imparted to one or more or all of the filaments as hereinafter described.

The term "equilibrium crystallization" is used herein with reference to a filament to mean that degree of crystallization normally obtained by the filament and beyond which significant crystallization does not occur with time. The term "partially crystalline" as used herein with reference to a filament means the filament has a degree of crystallinity but has not yet reached that degree of crystallinity that exists at its equilibrium crystallinity.

While the exact mechanism by which the process of this invention imparts latent crimp to a filament is not fully understood, it is believed that the latent crimp is imparted to the filament by virtue of the morphology of the filament being in a state of asymetry with respect to the plane transverse to its length at the time the filament is drawn. The heating of the filament apparently asymetrically induces in or relives stresses from the filament at a time while crystalline regions are developing therein. Drawing of the filament while it is in this state locks the asymetrical stresses into the filament until such a time the stresses are relieved, such as by subjecting the filament to heat while relaxed, which causes the filament to crimp.

The amount of heating required in the heating zone to provide a yarn having a desired level of latent crimp naturally will depend on the extrusion rate, the draw ratio and denier of the filaments and therefore must be correlated with these processing conditions. With these latter mentioned conditions being held constant it has been found that the latent crimp imparted to the yarn increases with increase heating of the yarn to a maximum latent crimp level and thereafter decreases with increase heating of the yarn. The amount of heating required in the heating zone to provide yarn having a desired level of latent crimp under a given set of processing conditions can easily be determined by a skilled practioner by merely varying the amount of heating in the heating zone until the desired level of latent crimp is attained.

Preferably, the yarn is heated from one side thereof and most preferably, from one side thereof by passing it into contact with a curved or flat heated surface, such as, one or more heated rolls or blocks. Generally, such rolls or blocks (hot shoes) are heated by electrical means. Of course, the temperature at which the heating means is maintained will depend on the residence time of the yarn in contact with the heated surface. The drawing of the heated yarn must be accomplished while at least one and preferably, all the filaments are partially crystalline if significant crimp is to be imparted thereto. The drawing step may be accomplished by conventional techniques.

Preferably, the heating and drawing steps are accomplished by passing freshly quenched yarn with several wraps around a first roll arrangement (a feed roll or feed roll and separator roll or a pair of feed rolls) and then around a second roll arrangement (draw roll and separator roll or a pair of draw rolls) where the draw roll(s) are driven at a peripheral speed greater than that of the feed roll(s). The yarn may take a circular or figure-eight path around each or either roll arrangement. The heating of the yarn is accomplished by heating and maintaining at least one of the feed rolls at a given temperature. The temperature of the heated feed roll(s) and number of wraps taken by the yarn around the first pair of rolls are correlated with the other processing conditions to provide yarn having a desired level of latent crimp. In the absence of a snubbing pin between the two pair of rolls to localize the point of draw, the yarn is drawn as it leaves the first pair of rolls. Under these conditions, with or without the snubbing pin, the filament(s) of the yarn are heated and only partially crystallizine when drawing thereof is initiated. Obviously, any treatment of the yarn after the heating step and prior to the drawing step which would cause all of the filaments to reach equilibrium crystallization must be avoided.

Depending on the manner in which the heating step is accomplished, the latent crimp imparted to a multifilament yarn may be regularly occurring or it may be randomly occurring along the length of the individual filaments and from filament to filament. When a large number of the filaments (>34) is heated by means of feed roll(s) in the manner described in the preceding paragraph, only a portion of the filaments of the yarn is in contact with the heated roll at any given time, that is, during a single wrap some of the filaments ride on top of other filaments and the position of the filaments changes from wrap to wrap. As a result, sections of each filament are heated to a greater extent than other sections and one or more sections of some of the filaments may not be heated at all. After development of the latent crimp, the resulting yarn has a random helical crimp, that is, some sections of each filament have a high crimp frequency, other sections have a moderate crimp frequency, other sections have a low crimp frequency, and still other sections may have no crimp at all. The crimp is also random from filament to filament. The randomness of the crimp renders the yarn particularly suitable for use in carpet constructions. However, if desired, it is contemplated that the randomness of the crimp can be reduced by more uniform heating of the filaments.

Yarn prepared by the process of this invention may be treated in a conventional manner to develop the latent crimp, such as, by heating the yarn while relaxed to a temperature between about 90° C. and about 220° C. with steam or dry heat. The resulting textured yarn retains its crimp upon cooling and will have a bulk of at least 10% and as high as 50% or even higher, as determined by the following formula:

$$\%\text{Bulk}=(L_1-L_2/L_1)\times 100,$$

where $L_1$ is a given length of yarn before development of the latent crimp and $L_2$ is the length of the same yarn ($L_1$) after the latent crimp has been developed by subjecting the length of yarn to 180° C. dry heat for five minutes followed by cooling of the yarn at ambient temperature for one minute. Then, the length of the yarn is again measured ($L_2$), stressed at 0.0009 gpd (grams per denier) load, 30 seconds after cooling. The crimp level of the resulting textured yarn can be determined by the following formula:

$$\%\text{Crimp}=(L_3-L_2/L_3)\times 100$$

where $L_2$ has the same meaning as above and $L_3$ is the length of the same yarn ($L_2$) after it has been stressed at 0.8 gpd. Preferably, yarns produced by the process of the invention will have a latent crimp of at least 10% and most preferably between 15 and 35%. The % thermal shrinkage (% TS) of the textured yarn can be calculated by the formula:

$$\%\text{TS}=(L_1-L_3/L_1)\times 100.$$

In carrying out the process of this invention the yarn may be collected in the form of continuous filament yarn or staple lengths, that is, the yarn may be collected on a bobbin or piddled into a container or cut into staple and then collected.

BRIEF DESCRIPTION OF THE DRAWING

The accompanying FIGURE is a schematic of an apparatus arrangement suitable for use in the process of the present invention.

DETAILED DESCRIPTION OF THE INVENTION

From the standpoint of commercial polyamide yarns, polyhexamethylene adipamide (nylon 66) and polycaprolactam (nylon 6) are preferred fiber-form polyamides for use in the process of this invention with nylon 66 being particularly preferred. However, other suitable polyamides include those formed by the polycondensation of one or more diamines of the formula $NH_2\text{-}(CH_2)_nNH$ with one or more diacids of the formula $HOOC\text{-}(CH_2)_nCOOH$ and/or HOOC-Ar-COOH, where n is an integer from 4 to 12 and Ar is

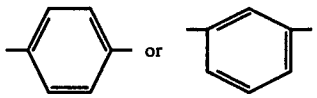

Examples of such polyamides include nylon 6TA/6IA, nylon 66/6TA, nylon 66/6TA/6IA and the like. The polyamides from which the yarns are produced may contain additives or modifies such as those commonly employed in textile and carpet yarns, for example, heat and light stabilizers, delusterants, dye additives or modifiers, flame retardants, antistatic agents and the like.

The process is described herein with reference to nylon 66. Although slight adjustments in processing conditions, such as temperature, time and drawing conditions, may be necessary to provide optimum bulk in other polyamide yarns, such conditions can be easily determined by routine experimentation. The bulk level of the polyamide yarn will normally be between 10% and 50% or higher. For carpet yarn applications a bulk level of at least about 10% and usually between 15 and 40% is desired. Process conditions which affect the bulk level of a yarn are described hereinafter.

In a preferred embodiment of the process of the invention disclosed in the FIGURE, molten fiber-forming nylon 66 of commercial grade is extruded at a given rate through orifices of Spinneret 1, to form molten streams which are cooled to form Filaments 2 in a cooling zone. Filaments 2 are withdrawn from the cooling zone and passed around Feed Roll 3 and its associated Separator Roll 4 with at least a partial wrap. The surface of Feed Roll 3 around which the filaments pass is heated, such as by electrical means, and maintained at a given temperature. Suitable electrically heatable rotatable rolls are commercially available. Filaments 2 are withdrawn from Feed Roll 3 and drawn at a given draw ratio prior to reaching their equilibrium crystallization by means of Draw Roll 5 and its associated Separator Roll 6. Draw Roll 5 is driven by a motor (not shown) at a peripheral speed which is greater than the peripheral speed of Feed Roll 3. If desired, a snubbing pin (draw pin) may be positioned between Feed Roll 3 and Draw Roll 5 to localize the point of draw. The extrusion rate, the drawing ratio, and the heating of the filaments (i.e. the temperature of heated Feed Roll 3 and number of wraps taken by the Filaments 2 around the heated Feed Roll 3) are correlated to provide a yarn of a given dpf having a desired level of latent crimp. Filaments 2 are then withdrawn from Draw Roll 5 after making one or more wraps (e.g. 5–13) around Rolls 5 and 6 and are fed by means of Traversing Guide 7 or other suitable means upon Wind-up Bobbin 8. Optionally, the filaments may be piddled into a container or cut into staple length and then collected. The extrusion rate and peripheral speeds of Rolls 3 and 5 are correlated to provide yarn of a desired denier per filament.

It will be understood that many prcocess variables have an affect on the level of latent crimp imparted to the yarn. The following discussion will consider the effect of changing only one variable at a time while leaving all other variables constant and is made with reference to producing nylon 66 yarn. It will be appreciated that there may be some interaction between some variables.

Filament Cross-Section

Yarns prepared by the process of the invention may be of any desired cross-section, e.g., the filaments may be of a circular, triangular, trilobal or triskelion cross-section.

Quenching Air

Cooling of the molten streams in the cooling zone may be assisted by a transverse or concurrent stream of flowing air in a quenching chamber, commonly referred to as a chimney. From the chimney, the filaments may pass through a steam conditioning tube. The use of cooling air and/or conditioning steam has not been found to have a significant affect on the amount of latent crimp imparted to the filaments.

Convergence Guides

While convergence guide(s) may be used in carrying out the process of this invention, for example in the chimney, it has been observed that the use of such guides tends to reduce the level of latent crimp otherwise imparted to the filaments.

Finish Roll

If desired, a finish may be applied to the filaments just prior to their contact with the feed roll. Conveniently, this is accomplished by passing the filaments over a roll which transfers a finish from a reservoir in which the roll is rotating on to the filaments. It has been observed that an increase in the level of latent crimp imparted to the filaments may be obtained by applying a finish to the filaments in the manner just described. It has also been observed that the amount of this increase in latent crimp is inversely proportional to the peripheral speed of the finish rolls.

Feed Roll

The feed roll arrangement conveniently consists of a conventional motor driven electrically heated roll and an associated separator roll. However, a single driven electrically heated roll might possibly be employed in which case the filaments will make a partial wrap or one or more wraps around such a roll. However, where a plurality of wraps are made by the filaments around a single roll, the filaments tend to snarl. It has been found that if the filaments in making wraps around the rolls are in contact with the heated feed roll (110° C.–140° C.) for a period of time less than about 0.01 second or greater than 1.00 second, the resulting filaments do not contain significant latent crimp. In producing filaments of about 20 denier, a contact time of between 0.05 and 0.3 second on a heated feed roll maintained at a temperature between about 110° C. and about 140° C. produces filaments having a potential bulk in the range of 15 to 40%. To produce 20 dpf nylon 66 yarn having significant potential bulk (>5%), the feed roll should be maintained at a temperature of at least about 70° C. Naturally, the feed roll should not be at such a high temperature that the filaments are deteriorated. At a given feed roll temperature, the bulk increases with increasing dwell time (residence time) through a maximum bulk and thereafter decreases with increasing dwell time. The peripheral speed and temperature of the feed roll can easily be correlated without undue experimentation to obtain yarn having an optimum (or desired) level of latent crimp.

It is contemplated that instead of using heated feed roll(s) to heat the filaments other heating means which contact the filament(s) or which heat the atmosphere in contact therewith might possibly be used alone or in combination with heated or cold feed rolls, such as, heated fluids, radiant or microwave heaters, etc.

Drawing

The filaments must be drawn prior to collection and preferably immediately after withdrawal from the heated feed roll. When producing 20 dpf nylon 66 yarn by the process of this invention using a heated feed roll maintained under the conditions specified in the preceding section, it has been found that the level of latent crimp imparted to the yarn increases with increasing draw ratios, passing through a maximum level at a draw ratio of about 1.75 and thereafter decreases. At a draw ratio of less than about 1.00 or greater than about 4.00, the amount of latent crimp imparted to the resulting filaments is less than desirable for most carpet applications. Preferably, at this dpf a draw ratio in the range of 1.75–3.25 is utilized. Naturally, the optimum draw ratio will vary depending on such factors as feed roll heating conditions, process speeds, denier of yarn and filaments, and the composition of the particular polyamide from which the filaments are formed. The use of a heated draw roll rather than an unheated draw roll has been found to produce a reduction in the level of latent crimp imparted to the filaments. The number of wraps which the filaments make around an unheated draw roll and its associated separator roll also has not been found to have a significant affect on the level of latent crimp imparted to the filaments.

The yarn, after drawing and before collection thereof, if desired, may be subjected to an interlacing device (e.g. fluid jet) to increase its coherency and/or predevelope some of its crimp. In using a jet, the fluid may be ambient air or hot air or steam. It will be understood that the use of such a jet may superimpose an additional crimp to the yarn and/or reduce its thermal shrinkage.

Denier

For carpet yarn applications, the denier per filament will normally range from 6 to about 22 and a bulk in the range of 15%–40% is desirable. It has been found that the latent crimp imparted to the yarn increases with increasing denier per filament.

Processing Yarn Speeds

The extrusion rate and peripheral speed of the feed roll(s) and draw roll(s) are correlated to obtain yarn of a desired dpf (denier per filament). The peripheral speed of the feed roll(s) and/or draw roll(s) may vary over a wide range, for example, the peripheral speed of the feed roll(s) may range from 350 meters/min. to 1200 meters/min. and higher. The level of latent crimp imparted to the yarn at a given feed roll speed, of course, will depend on the correlation of the various above-mentioned processing conditions.

The following examples are given for purposes of further illustrating the invention but are not in any way intended to limit the invention to the particular embodiments described therein.

EXAMPLES 1-16

These examples illustrate the production of 95 filament nylon 66 yarns utilizing the process of the invention.

Each yarn was prepared under slightly different processing conditions in order to illustrate the affect of various processing conditions on the bulk level and crimp level of the yarns. The following procedure and arrangement of apparatus were employed in preparing the yarns. Fiber-forming nylon of commercial grade was extruded at a melt temperature of 282° C. downwardly through the orifices of a 95-hole spinneret into a conventional melt spinning chimney, measuring approximately 6 ft. (1.8 m) in length. The chimney was adapted to receive a cross-flow of cooling air at ambient temperature flowing at 270 cubic feet per minute (cfm). The molten streams solidified in the chimney to form filaments. The filaments passed immediately from the chimney through a conventional steam conditioning tube measuring about 4 ft. (1.2 m) in length. (No steam or other fluid, however, was introduced into the tube.) The filaments were passed from the conditioning tube over a conventional driven finish applicator roll where, with the exception of Example 3, a finish was applied thereto. The filaments converged on the finish roll and then passed immediately over and around a driven electrically heated feed roll and its associated separator roll with several wraps. The feed roll was driven at a given peripheral speed and maintained at a given temperature. The yarn was passed from the heated feed roll over and around a driven draw roll (cold) and its associated separator roll with several wraps. The draw roll was driven at a peripheral speed greater than the peripheral speed of the heated feed roll. The yarn was then withdrawn from the draw roll and wound onto a bobbin. The % bulk and % crimp of each of the yarns were determined and are given in the following table along with the specific processing conditions employed to prepare each yarn.

TABLE

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 | Ex. 14 | Ex. 15 | Ex. 16 |
|---|---|---|---|---|---|---|---|---|---|---|---|---|---|---|---|---|
| Spinneret Orifice Cross-Section | Triskelion | → | → | → | → | → | → | → | → | → | round Triskelion | → | → | → | → | → |
| Quenching Air | Yes | No | Yes | → | → | → | → | → | → | → | → | → | → | → | → | → |
| Flow(cfm) | 270 | → | 270 | → | → | → | → | → | → | → | → | → | → | → | → | → |
| Temp. °F. | 82 | → | 82 | → | → | → | → | → | → | → | → | → | → | → | → | → |
| Finish Roll | | | | | | | | | | | | | | | | |
| Speed(m/min) | 8.9 | → | 0 | 8.9 | → | → | → | → | → | → | → | → | → | → | → | → |
| rpm | 14 | → | 0 | 14 | → | → | → | → | → | → | → | → | → | → | → | → |
| Feed Roll | | | | | | | | | | | | | | | | |
| Speed(m/min) | 640 | → | → | → | → | → | → | → | → | → | → | → | 457 | 510 | 610 | → |
| rpm | 1358 | → | → | → | → | → | → | → | → | → | → | → | 962 | 1073 | 1283 | → |
| Wraps | 5 | → | → | 3 | 8 | 5 | → | → | → | → | → | → | → | → | → | 5 |
| Temp. °C. | 130 | → | → | → | → | 100 | 150 | 130 | → | → | 125 | 140 | → | 130 | 175 | ambient |
| Residence Time of Yarn, sec. | 0.17 | → | → | 0.10 | 0.27 | 0.17 | → | → | → | → | → | → | 0.23 | 0.21 | 0.017 | → |
| Draw Roll | | | | | | | | | | | | | | | | |
| Speed(m/min) | 1417 | → | → | → | → | → | → | 1760 | 640 | 1417 | → | → | 1005 | 1595 | → | → |
| rpm | 3008 | → | → | → | → | → | → | 3735 | 1300 | 3008 | → | → | 2115 | 3353 | → | → |
| Temp. °C. | Ambient | → | → | → | → | → | → | → | → | → | → | → | → | → | → | → |
| Wraps | 12 | → | → | → | → | → | → | → | → | → | → | → | → | → | → | → |
| Draw Ratio | 2.21 | → | → | → | → | → | → | 2.75 | 1.00 | 2.21 | → | → | 2.20 | 2.97 | 2.62 | → |
| Polymer Throughput | | | | | | | | | | | | | | | | |
| lbs/hr | 33.6 | → | → | → | → | → | → | → | → | 28.8 | 36.9 | 35.4 | → | 34.9 | → | → |
| Kg/hr | 15.3 | → | → | → | → | → | → | → | → | 13.1 | 16.8 | 16.1 | → | 15.8 | → | → |
| Bulk, % | 37.1 | 32.1 | 19.0 | 33.5 | 28.5 | 21.7 | 32.6 | 24.9 | 1.80 | 34.4 | 18.1 | 38.0 | 35.3 | 17.6 | 20.8 | 5.9 |
| Crimp, % | 29.8 | 23.4 | 7.2 | 29.3 | 18.6 | 17.2 | 23.6 | 15.7 | 1.80 | 26.8 | 13.4 | 30.4 | 27.8 | 10.3 | 12.0 | 3.7 |
| Yarn Denier | 1864 | 1864 | 1830 | 1850 | 1880 | 1852 | 1848 | 1500 | 3960 | 1596 | 2048 | 1964 | 2784 | 1770 | 1780 | 1850 |

TABLE-continued

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 | Ex. 14 | Ex. 15 | Ex. 16 |
|---|---|---|---|---|---|---|---|---|---|---|---|---|---|---|---|---|
| Filament Denier | 20 | 20 | 19 | 19 | 20 | 19 | 19 | 16 | 42 | 17 | 15 | 14 | 20 | 19 | 19 | 19 |
| Thermal Shrinkage, % | 10.4 | 11.3 | 12.7 | 5.9 | 12.2 | 5.4 | 11.8 | 10.9 | 0 | 10.4 | 5.4 | 10.9 | 10.4 | 8.1 | 10.0 | 2.3 |

Example 1 illustrates an optimum set of conditions that may be used for producing a 20 dpf bulked yarn. Examples 2–16 show the effect on bulk of changing a particular condition while holding other conditions the same.

Example 2 illustrates that while quenching air may be beneficially used with the process of the invention, the use of such is not essential.

Example 3 illustrates that while a finish may be beneficially applied to the yarn, the application thereof is not essential to the process.

Examples 4 and 5 illustrate that the residence time of the yarn in contact with the heated feed roll has an effect on the bulk level of the resulting yarn. In Example 4 the residence time is less than in Example 1 while in Example 5 it is greater. In both instances however the % bulk is less. These data demonstrate that an increase or decrease in the optimum residence time results in a lower bulk level.

Examples 6 and 7 illustrate that reducing or increasing the feed roll temperature from the optimum temperature results in a lower bulk level.

Example 8 illustrates that increasing the draw ratio beyond the optimum ratio results in a lower bulk level.

Example 9 illustrates that if the yarn is not drawn at all substantially no bulk is imparted to the yarn.

Example 10 illustrates that decreasing the polymer throughput or dpf tends to lower the bulk level slightly.

Example 11 illustrates that the process can be effectively employed to impart bulk to filaments of round cross-section.

Example 12 illustrates optimum conditions at a slightly higher polymer throughput rate and at a slightly higher feed roll temperature (140° C.) than was used in Example 1 (130° C.). The resulting yarn had a slightly higher bulk level.

Example 13 illustrates that increasing the residence time of the yarn on the feed roll at the higher feed roll temperature (140° C.) resulted in a slight decrease in the bulk level.

Example 14 illustrates a decrease in bulk level results upon increasing the draw ratio from 2.21 (Example 1) to 2.97.

Example 15 illustrates utilizing a relatively high feed roll temperature (175° C.) and a moderately high draw ratio (2.62).

Example 16 illustrates that when the feed roll is not heated the resulting yarn does not contain significant or usable bulk.

EXAMPLE 17

In this example as-spun yarn obtained as in Example 9 was subsequently drawn in a separate operation in which the yarn was passed over a heated feed roll and draw rolls as in Example 1. In this instance the resulting drawn yarn did not contain significant or usable bulk, that is, the bulk level was less than 2%. This example illustrates the importance of drawing the yarn before the filaments have attained their equilibrium crystallization.

EXAMPLE 18

In this example yarn was prepared as in Example 1 with the exception that instead of making circular wraps around the pair of feed rolls the yarn made figure-eight wraps (i.e. the path of the yarn was under the first roll, over and around the second roll, over and under the first roll, etc.). The resulting yarn after development of its latent crimp had a bulk and crimp level comparable to the yarn of Example 1.

EXAMPLE 19

In this example yarn was prepared as in Example 1 except that the yarn was passed through an interlacing device prior to being wound onto the finished package. This interlacing device was of the turbulent fluid type utilizing heated air at 250° C. and 125 psig (9.8 Kg/cm$^2$) as the fluid. The yarn was overfed through this device by approximately 5 to 10%. The resulting yarn had a bulk, crimp, and thermal shrinkage of 24.0%, 19.7%, and 5.4%, respectively, and a tangle level of 14.4 tangles per meter, as measured on a randomly selected 10-foot (3.05 meter) length.

EXAMPLE 20

In this example yarn was prepared as in Example 8 except in this example an anhydrous finish solution was applied to the yarn instead of the aqueous finish solution (80% water) which was applied in all the previous examples (except Example 3). The finish roll speed was adjusted to maintain an oil-on-yarn level that was consistant with the other examples. The resulting yarn (after development of the latent crimp) had bulk, crimp and thermal shrinkage levels of 22.6%, 12.2%, and 11.8%, respectively. The results of this example indicate that the plasticization effect normally achieved with application of water onto nylon has no significant effect on the bulk and other properties of yarns produced by the process of this invention.

We claim:

1. A process for continuously melt spinning and drawing multifilament polyamide yarn whereby latent crimp is imparted to the yarn during the drawing thereof without the use of special crimping equipment, comprising:

(a) extruding molten fiber-forming polyamide through orifices of a spinneret to form a plurality of molten streams, (b) cooling the molten streams in a quenching zone to form solid filaments, (c) heating said filaments by passing the filaments from said quenching zone with a given number of wraps around a first roll arrangement rotating at a given peripheral speed and having at least one roll maintained at a temperature of at least 70° C. but less than that temperature at which deterioration of the filaments occur, (d) drawing said filaments by passing the filaments from said first roll arrangement with a plurality of wraps around a second roll arrangement rotating at a peripheral speed such that the filaments are drawn between said first and second roll arrangements at a draw ratio ranging from greater than 1.0 to less than 4.0, wherein said drawing is accomplished before the filaments reach equilibrium crystallization and, (e) collecting said filaments in the form of a yarn, said process being characterized in that said temperature, said number of wraps taken around said first roll arrangement and said draw ratio are correlated to provide a yarn having at least 10% crimp as determined by the formula % crimp$=(L_3-L_2/L_3)\times 100$ where $L_2$ and $L_3$ represent the length of a sample of said yarn after the sample has been exposed to 180° C. dry heat for 5 minutes followed by cooling for 1 minute, first measured stressed at 0.0009 grams per denier ($L_2$) and then measured stressed at 0.8 grams per denier ($L_3$).

2. The process of claim 1 wherein said crimp is at least 15%.

3. The process of claim 2 wherein said temperature is between 100° C. and 175° C. and said draw ratio is between 1.75 and 3.25.

4. The process of claim 3 wherein said cooling is assisted by means of a transverse stream of flowing air.

5. The process of claim 4 wherein a finish is applied to the filaments before said filaments are passed around said first roll arrangement.

6. The process of claim 5 wherein said polyamide is polyhexamethylene adipamide.

7. The process of claim 6 wherein said first roll arrangement comprises a driven heated roll and an associated separator roll.

8. The process of claim 7 wherein said second roll arrangement comprises a driven roll and an associated separator roll.

9. The process of claim 8 wherein each filament has a denier between 6 and 22.

10. The process of claim 9 wherein said orifices are of a non-round cross-section.

11. The process of claim 10 wherein said number of wraps taken around said heated roll is such that the filaments are in contact with the heated roll for a period of time ranging from 0.01 to 1.00 second.

12. The process of claim 11 wherein said period of time is between 0.05 to 0.30 second.

13. The process of claim 12 wherein said draw ratio is between 2.20 and 2.97.

14. The process of claim 12 wherein said yarn has a nominal denier per filament of 20.

15. A process for continuously melt spinning and drawing polyamide yarn whereby latent crimp is imparted to the yarn during the drawing thereof without the use of special crimping equipment, comprising:

(a) extruding molten fiber-forming polyamide through orifices of a spinneret to form molten streams, (b) cooling said molten streams in a quenching zone to form filaments, (c) passing said filaments from said quenching zone with a plurality of wraps around a first roll arrangement rotating at a given peripheral speed, (d) heating a plurality of said filaments by passing the filaments from said first roll arrangement into contact with a hot shoe or series of hot shoes, (e) passing said filaments from contact with said hot shoe(s) with a plurality of wraps around a second roll arrangement rotating at a peripheral speed such that the filaments are drawn between said roll arrangements at a draw ratio ranging from greater than 1.0 and less than 4.0, wherein said drawing is accomplished before the filaments reach equilibrium crystallization, and (f) collecting said filaments in the form of a yarn, wherein the heating of said plurality of said filaments and said draw ratio are correlated to provide a yarn having at least 10% crimp as determined by the formula % crimp$=(L_3-L_2/L_3)\times 100$ where $L_2$ and $L_3$ represent the length of a sample of said yarn after the sample has been exposed to 180° C. dry heat for 5 minutes followed by cooling for 1 minute, first measured stressed at 0.0009 grams per denier ($L_2$) and then measured stressed at 0.8 grams per denier ($L_3$).

* * * * *